US010056210B2

(12) United States Patent
Marzano et al.

(10) Patent No.: US 10,056,210 B2
(45) Date of Patent: Aug. 21, 2018

(54) ARC CHAMBER ASSEMBLY AND METHOD

(71) Applicant: Rockwell Automation Switzerland GmbH, Aarau (CH)

(72) Inventors: Thomas Strebel Marzano, Birmenstorf AG (CH); Beat Villiger, Reinach AG (CH)

(73) Assignee: Rockwell Automation Switzerland GmbH, Aarau (CH)

( * ) Notice: Subject to any disclaimer, the term of this patent is extended or adjusted under 35 U.S.C. 154(b) by 0 days.

(21) Appl. No.: 14/995,750

(22) Filed: Jan. 14, 2016

(65) Prior Publication Data

US 2017/0207045 A1 Jul. 20, 2017

(51) Int. Cl.

| | |
|---|---|
| ***H01H 33/18*** | (2006.01) |
| ***H01H 33/08*** | (2006.01) |
| ***H01H 33/74*** | (2006.01) |

(52) U.S. Cl.

CPC ..... *H01H 33/18* (2013.01); *H01H 33/08* (2013.01); *H01H 33/74* (2013.01); *H01H 2205/002* (2013.01)

(58) Field of Classification Search

CPC ..... H01H 33/08; H01H 33/18; H01H 33/74; H01H 9/342; H01H 9/346; H01H 33/02

USPC ..... 218/34, 30, 31, 35, 81, 103, 149, 155, 218/156; 335/201, 202

See application file for complete search history.

(56) References Cited

U.S. PATENT DOCUMENTS

| | | | | |
|---|---|---|---|---|
| 6,248,970 | B1 | 6/2001 | DiMarco et al. | |
| 6,262,384 | B1 | 7/2001 | Niebler et al. | |
| 6,288,354 | B1 | 9/2001 | Niebler et al. | |
| 6,703,575 | B1 * | 3/2004 | Yamamoto | H01H 9/342 218/46 |
| 7,034,242 | B1 | 4/2006 | Shea et al. | |
| 7,094,986 | B2 | 8/2006 | Shea | |
| 7,186,941 | B2 * | 3/2007 | Yeon | H01H 9/302 218/38 |
| 7,285,742 | B2 * | 10/2007 | Kinzler | H01H 71/0207 218/34 |
| 7,716,816 | B2 * | 5/2010 | Annis | H01H 9/446 29/622 |
| 8,097,824 | B2 * | 1/2012 | Kil | H01H 9/36 218/149 |
| 2007/0056931 | A1 | 3/2007 | Turkmen | |
| 2009/0179010 | A1 * | 7/2009 | Asokan | H01H 9/302 218/157 |
| 2009/0255904 | A1 | 10/2009 | Andre et al. | |
| 2010/0258413 | A1 * | 10/2010 | Leischner | H01H 19/64 200/11 R |
| 2014/0346146 | A1 | 11/2014 | Kharade | |

* cited by examiner

*Primary Examiner* — Renee Luebke
*Assistant Examiner* — William Bolton
(74) *Attorney, Agent, or Firm* — Timothy P. Boppre

(57) ABSTRACT

The present disclosure describes an apparatus and method for quenching the arc developed during the interruption of a current carrying path by use of an arc quenching apparatus with a contiguous chamber that shapes and directs the gas pressure and other associated arc components through a set of splitter plates located at the ends of the chamber. The contiguous chamber contains the gas pressure and other associated arc components for the duration of the quenching process.

8 Claims, 14 Drawing Sheets

ARC CHAMBER ASSEMBLY AND METHOD

BACKGROUND

The invention relates generally to the field of circuit interrupting devices. More particularly the invention relates to a technique for quenching an arc that results from interruption of a current carrying path between a source of electrical power and a load.

Various circuit interrupters are currently available and have been developed for interrupting a current carrying path between a source of electrical power and a load. These circuit interrupting devices may take the form of circuit breakers, contactors, relays, motor starters and the like. In general, such devices include one or more moveable contacts and associated one or more stationary contacts. The contacts are joined to complete a current carrying path through the device during normal operation. The contacts may be separated in response to desired events such as turning off a circuit breaker or de-energizing the coil voltage of a relay or contactor in addition to fault conditions such as current overload, thermal protection, or other undesired events. Upon separation of the contacts an electrical arc is generated which results in an increase in temperature and pressure inside the circuit interrupting device. It is desirable to dissipate, extinguish, or quench the arc quickly so as to prevent damage to the contacts of the circuit interrupting device, the device itself, or the load that is being protected.

There have been various approaches to improve extinguishing an arc in a circuit interrupter. These techniques include lengthening the arc column by increasing the separation of the contacts, constricting the arc so as to increase the pressure resulting in a decreased arc diameter, and introducing ferromagnetic plates which attract the arc and split it into smaller arcs. Additional benefit is gained by the introduction of materials that undergo surface ablation during the arc event which aid in the rapid expansion and extinguishing of the arc. While the various combinations of these techniques are useful in quenching an arc there is a need for further improvement in the containment of the arc pressure generated as a result of the circuit interruption event in order to dissipate an arc more quickly and efficiently

BRIEF DESCRIPTION

The embodiments in the present disclosure provide a novel technique for improved arc extinguishment. The approach may be implemented in a variety of circuit interrupting devices such as circuit breakers, contactors, or relays, with both single and multiple current carrying paths. The operation of these devices may take a variety of mechanical and electromechanical approaches to control the position of the contacts in order to complete and interrupt an electrical circuit. The present disclosure makes reference to a circuit breaker for the purpose of illustration but it is to be understood that this is solely for the purpose of explanation and in no way limits the invention to this particular device.

An embodiment described provides an improvement in arc quenching by containing the gas generated as a result of the circuit interruption event inside the arc chamber assembly for an increased period of time resulting in an increase in pressure which reduces the time required to extinguish the arc.

In accordance with a further aspect of the invention the arc chamber framework may be embodied as a single-piece or as a two-piece part for ease of manufacture and assembly.

DRAWINGS

These and other features, aspects, and advantages of the present invention will become better understood when the following detailed description is read with reference to the accompanying drawings in which like characters represent like parts throughout the drawings, wherein.

Figure 7A:
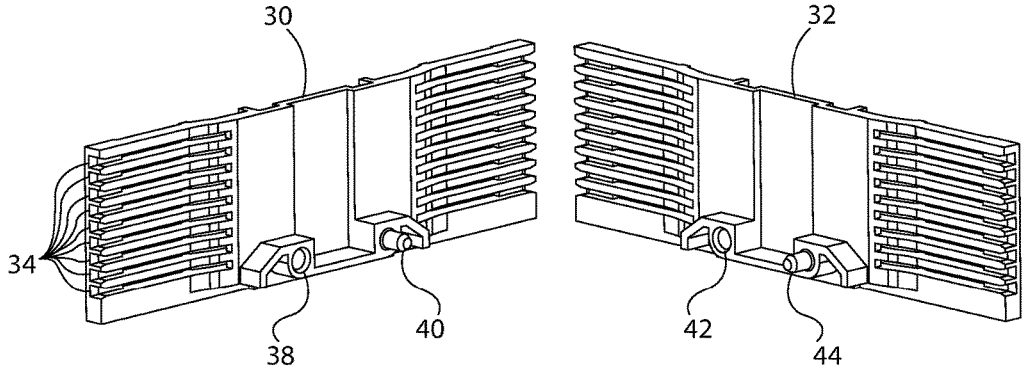
Figure 7B:
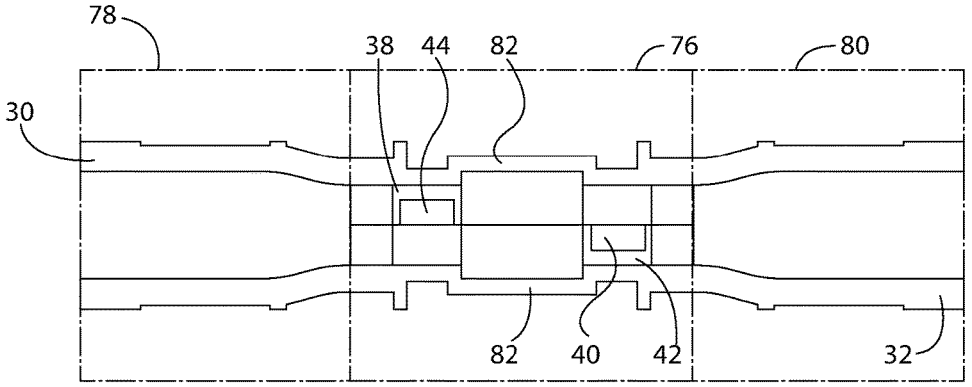
Figure 7C:
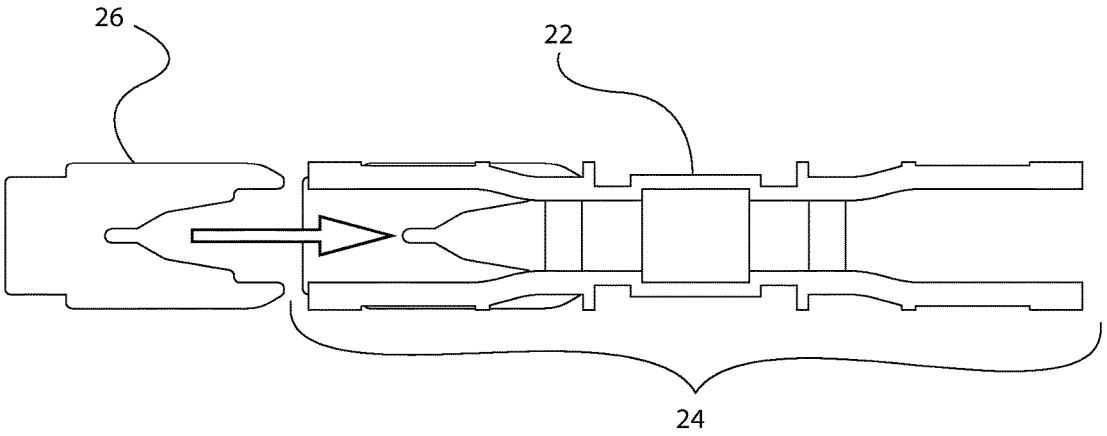
Figure 7D:
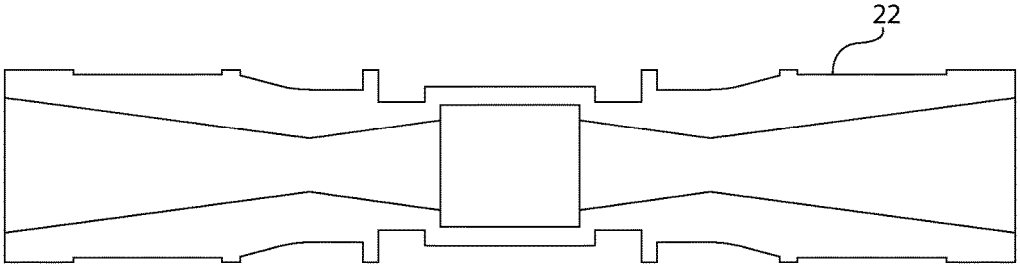
Figure 7E:
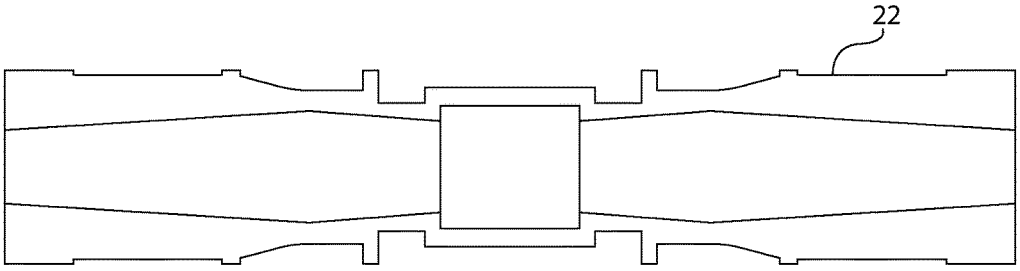
Figure 8A:
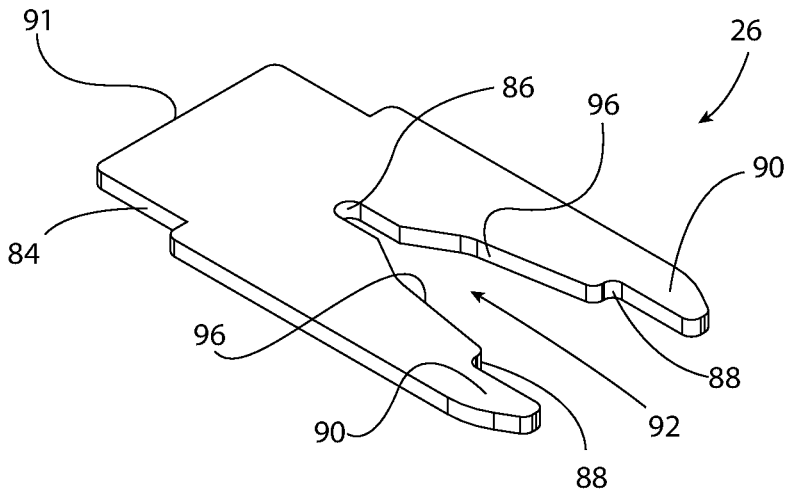
Figure 8B:
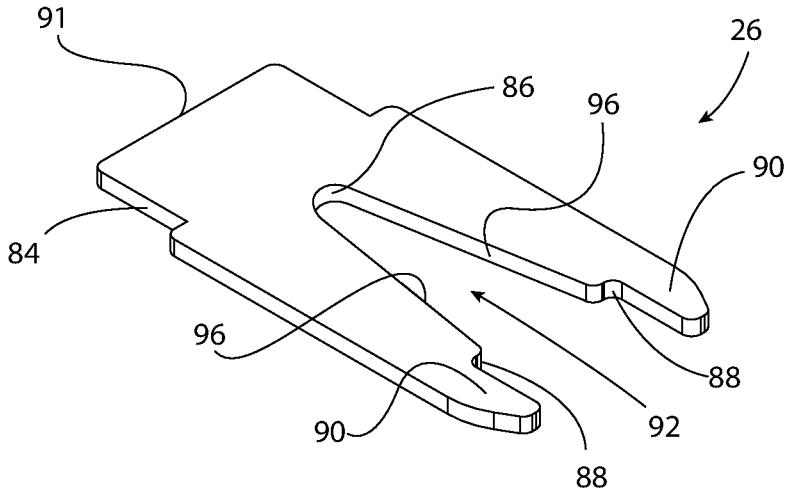
Figure 9:
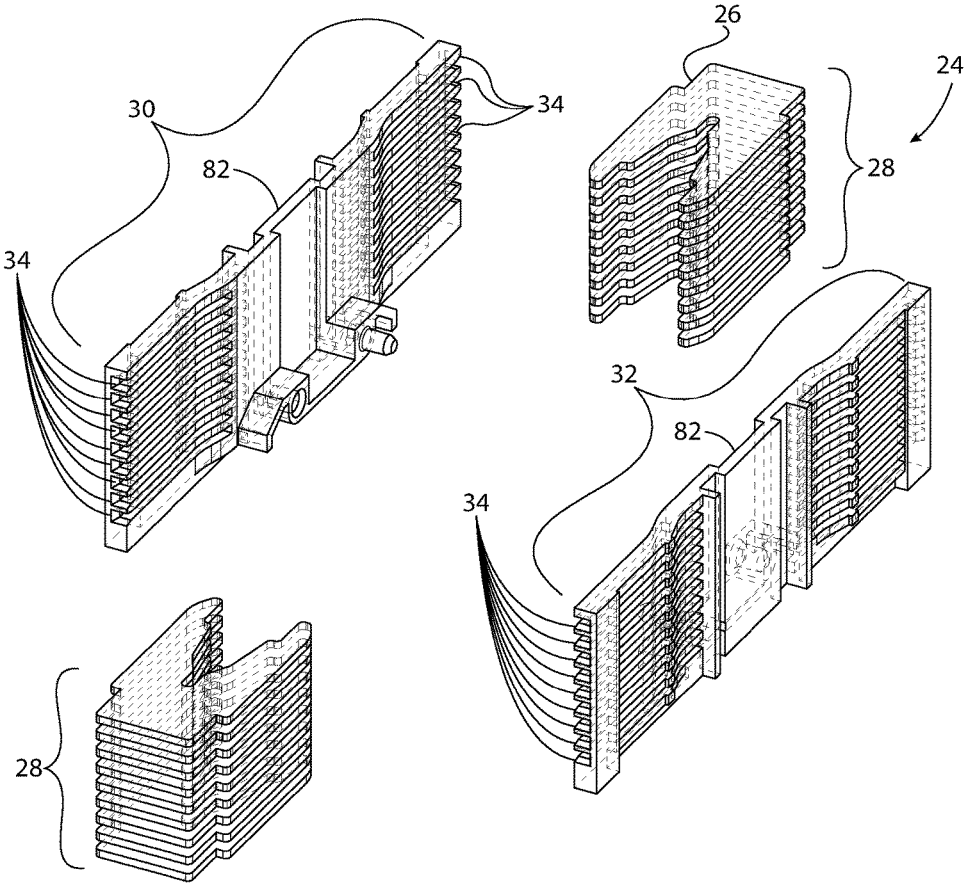
Figure 9B:
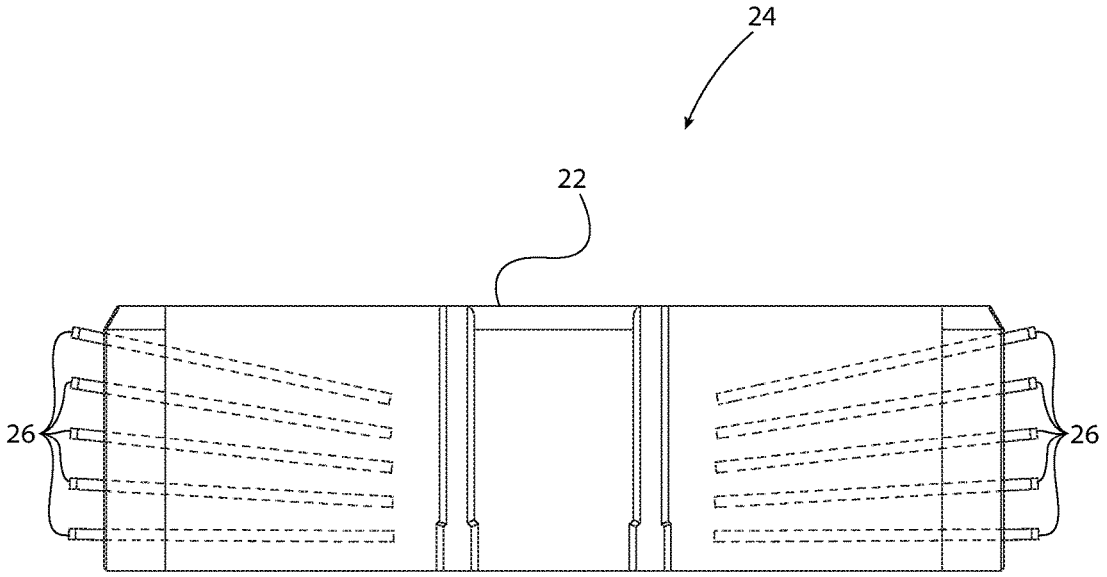
Figures 10A, 10B, 10C:
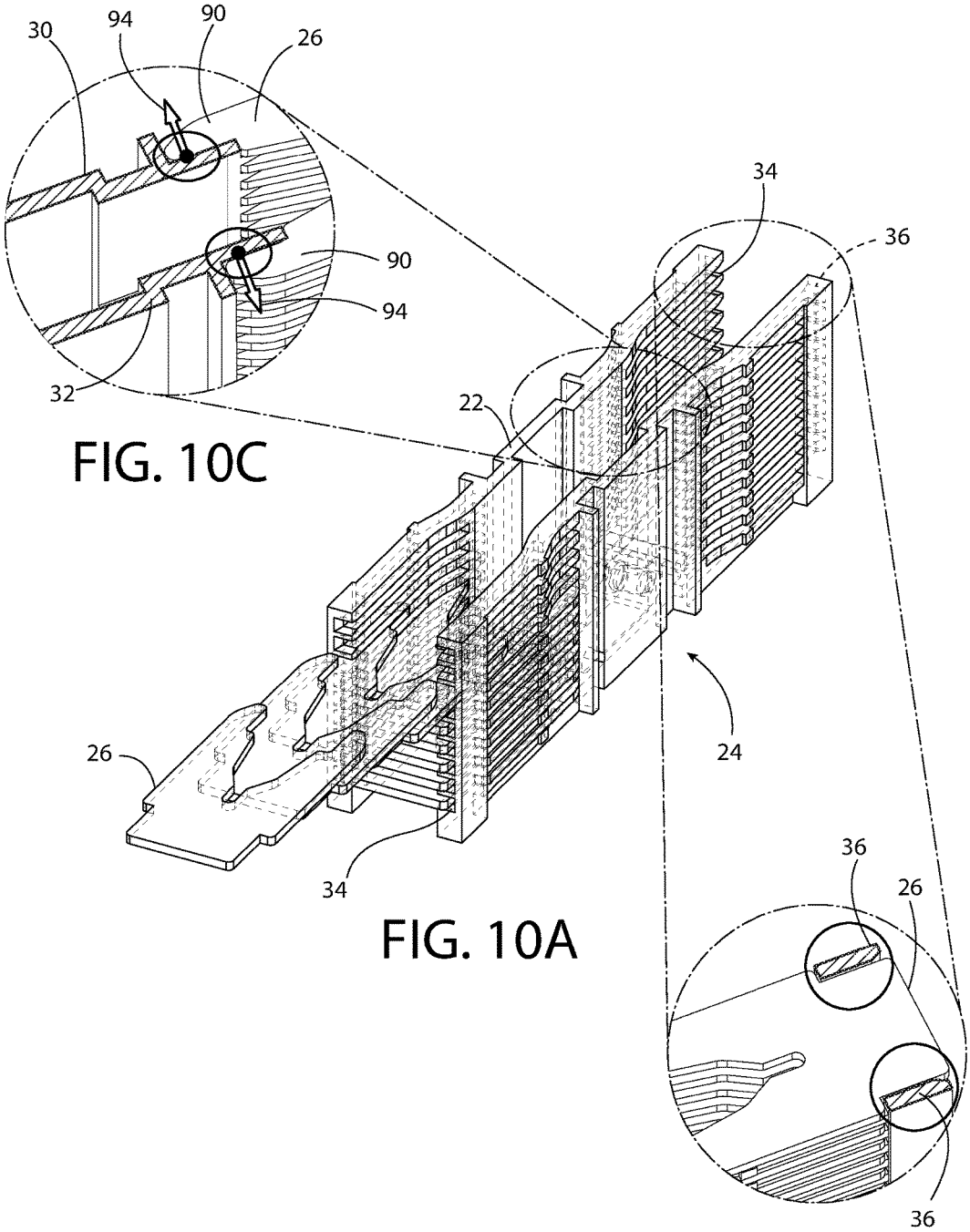
Figure 11A:
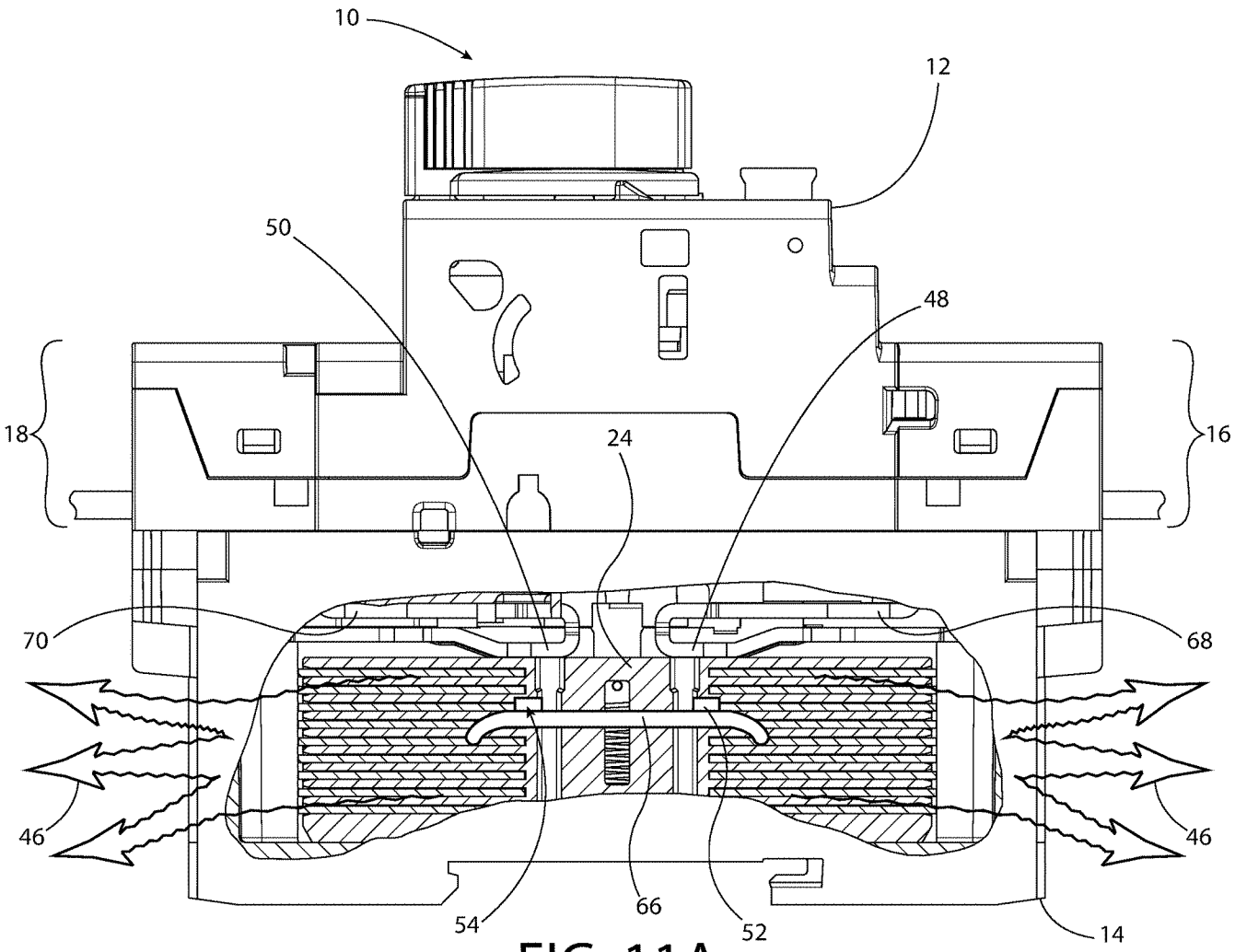
Figure 11B:
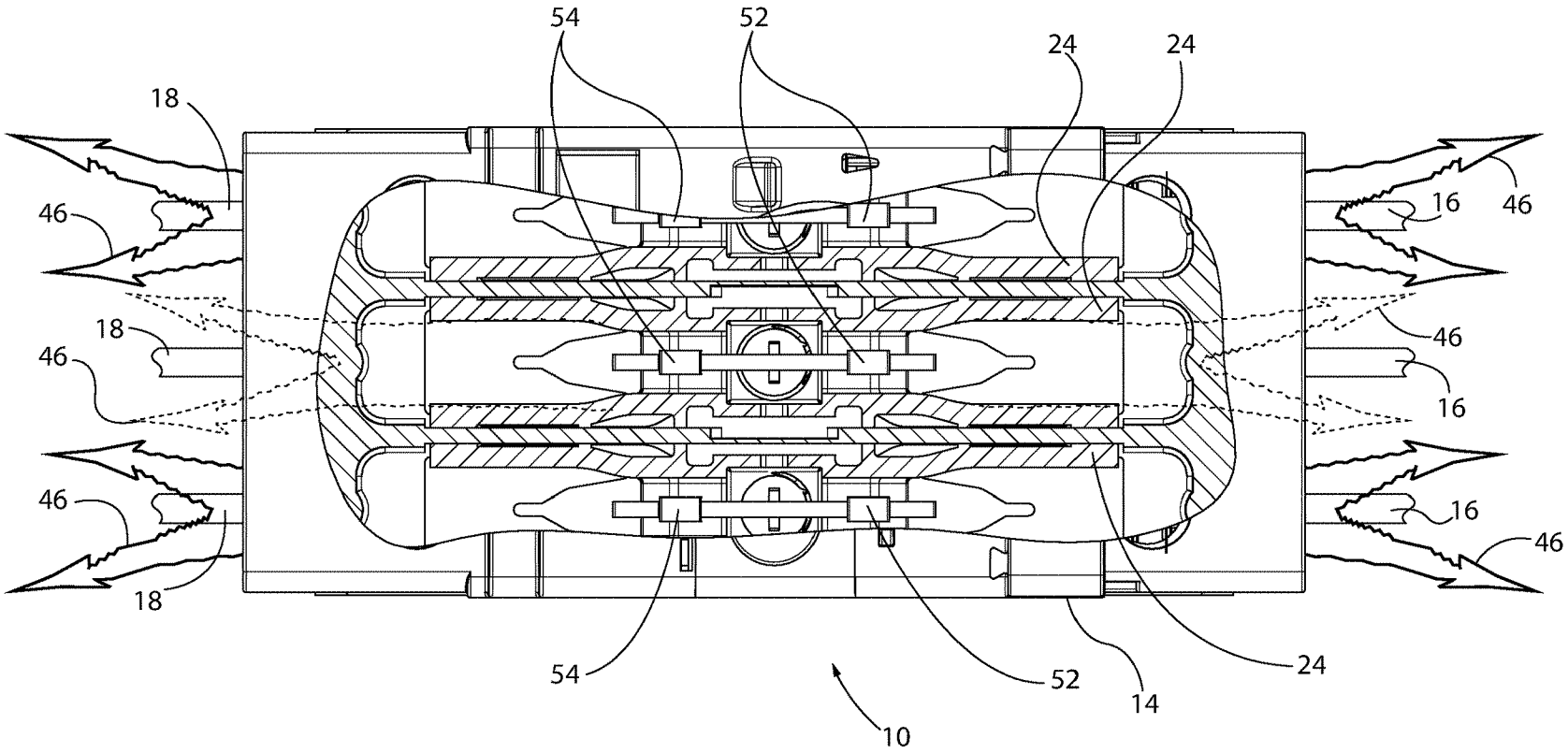
Figure 12:
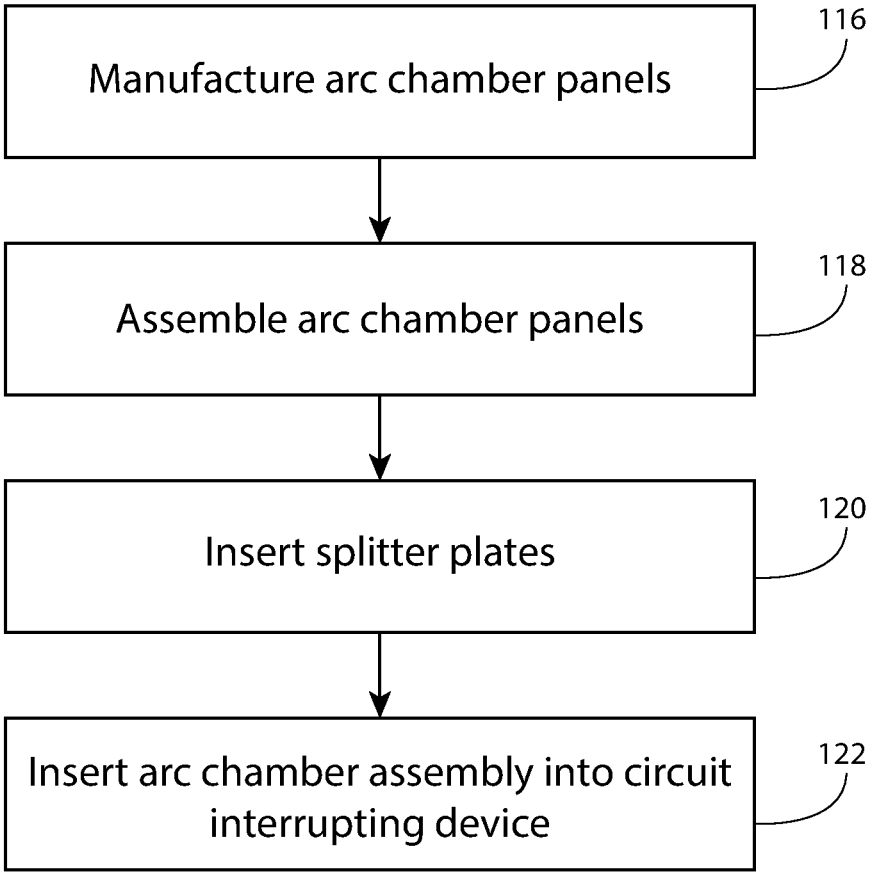

FIG. 7*a* is an assembly view of an embodiment of an arc chamber framework;

FIG. 7*b* is a top view of an embodiment of an arc chamber framework as a two-piece unit;

FIG. 7*c* is a top view of an alternate embodiment of an arc chamber framework as an integrally formed unit;

FIG. 7*d* is top view of another alternate embodiment of an arc chamber framework;

FIG. 7*e* is top view of another alternate embodiment of an arc chamber framework;

FIG. 8*a* is perspective view of an embodiment of a splitter plate;

FIG. 8*b* is perspective view of an alternate embodiment of a splitter plate;

FIG. 9 is an exploded perspective view of an arc chamber assembly;

FIG. 9*b* is a side view of an alternate embodiment of the arc chamber assembly with splitter plates;

FIG. 10*a* is a perspective view of an arc chamber assembly illustrating splitter plate insertion;

FIG. 10*b* is a detail view of the distal end of the splitter plates in the arc chamber framework showing retention notches;

FIG. 10*c* is a detail view of the proximal end of the splitter plates in the arc chamber framework;

FIG. 11*a* is a side view cutaway of a three phase circuit breaker illustrating an arc chamber assembly, contacts, and gas pressure flow;

FIG. 11*b* is a top view cutaway of a three phase circuit breaker illustrating an arc chamber assembly, contacts, and gas pressure flow; and FIG. 12 is a flowchart representing the method of manufacturing and assembly of an arc chamber assembly.

DETAILED DESCRIPTION

Figure 1:
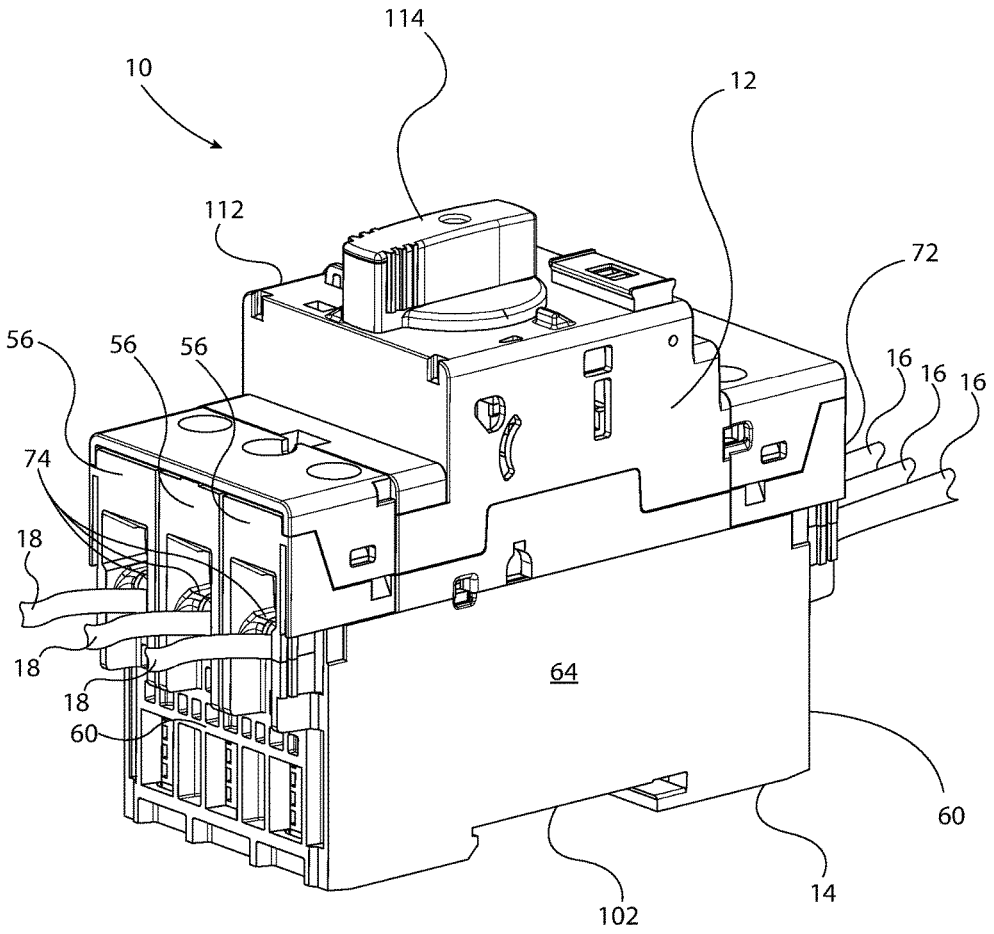
FIG. 1 is a perspective view of a three phase circuit breaker.

Turning now to the drawings, and referring to FIG. 1, a circuit interrupting device is illustrated in the form of a three-phase circuit breaker 10 for controlling electrical current carrying paths for three separate phases of electrical power. The circuit breaker 10 of FIG. 1 includes an upper housing 12 and a lower housing 14 each of which is divided into three electrically isolated phase sections 56. Each of these electrically isolated phase sections 56 is configured to receive electrical inputs via power input conductors 16 connected to power terminal blocks 72, one for each phase, and deliver electrical outputs to a load via load output conductors 18 connected to load terminal blocks 74, one for each phase, when the circuit interrupting device 10 is placed in a state resulting in a completed electrical circuit.

Figure 2:
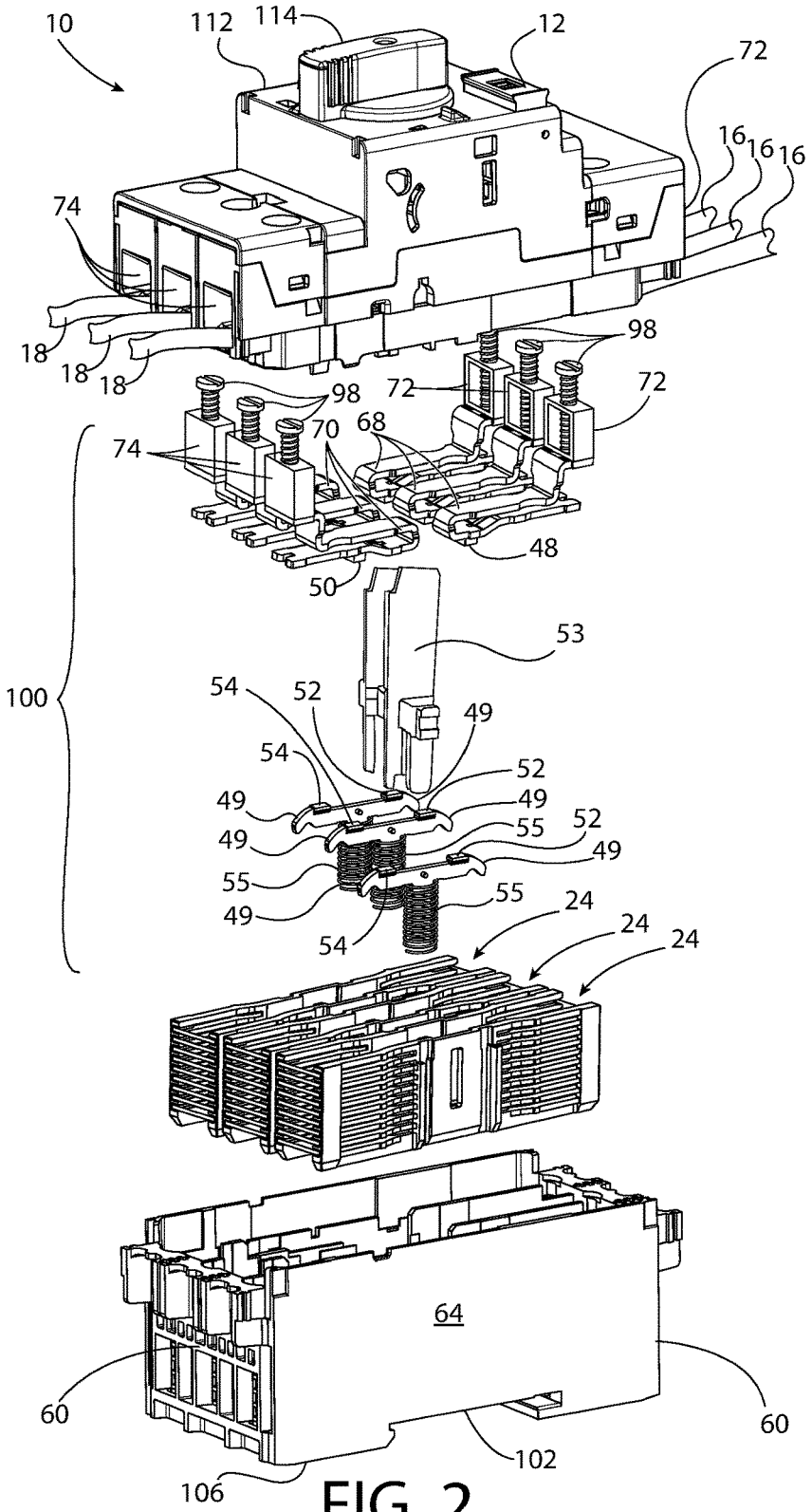
FIG. 2 is an exploded view of a three phase circuit breaker showing multiple arc chamber assemblies and electrical contact assemblies.

FIG. 2 illustrates circuit interrupting device 10 in an exploded perspective view with upper housing 12 and lower housing 14 of circuit breaker 10 positioned such that the arc chamber assemblies 24 for each of the three phases in addition to the contact assemblies 100, and the internal operating or linking member 53, is shown. In the embodiment illustrated, that of a circuit breaker, the operator for the circuit interrupting device comprises an assembly of an external rotatable operating member 114 and an internal operating or linking member 53 which positions the movable contact arms 49 into relation with the power contact arms 68 and the load contact arms 70 in order to either complete or interrupt the electrical circuit when rotatable operating member 114 is rotated through its range. In other embodiments the external rotatable operating member 114 could take the form of a toggle switch, a push button, a latch, or be replaced by an electromagnetic coil assembly such that the energizing or de-energizing of a coil would cause the internal operating member 53 to position the contacts and control the electrical circuits of the circuit interrupting device 10 as in the case of a relay or contactor.

Figure 3:
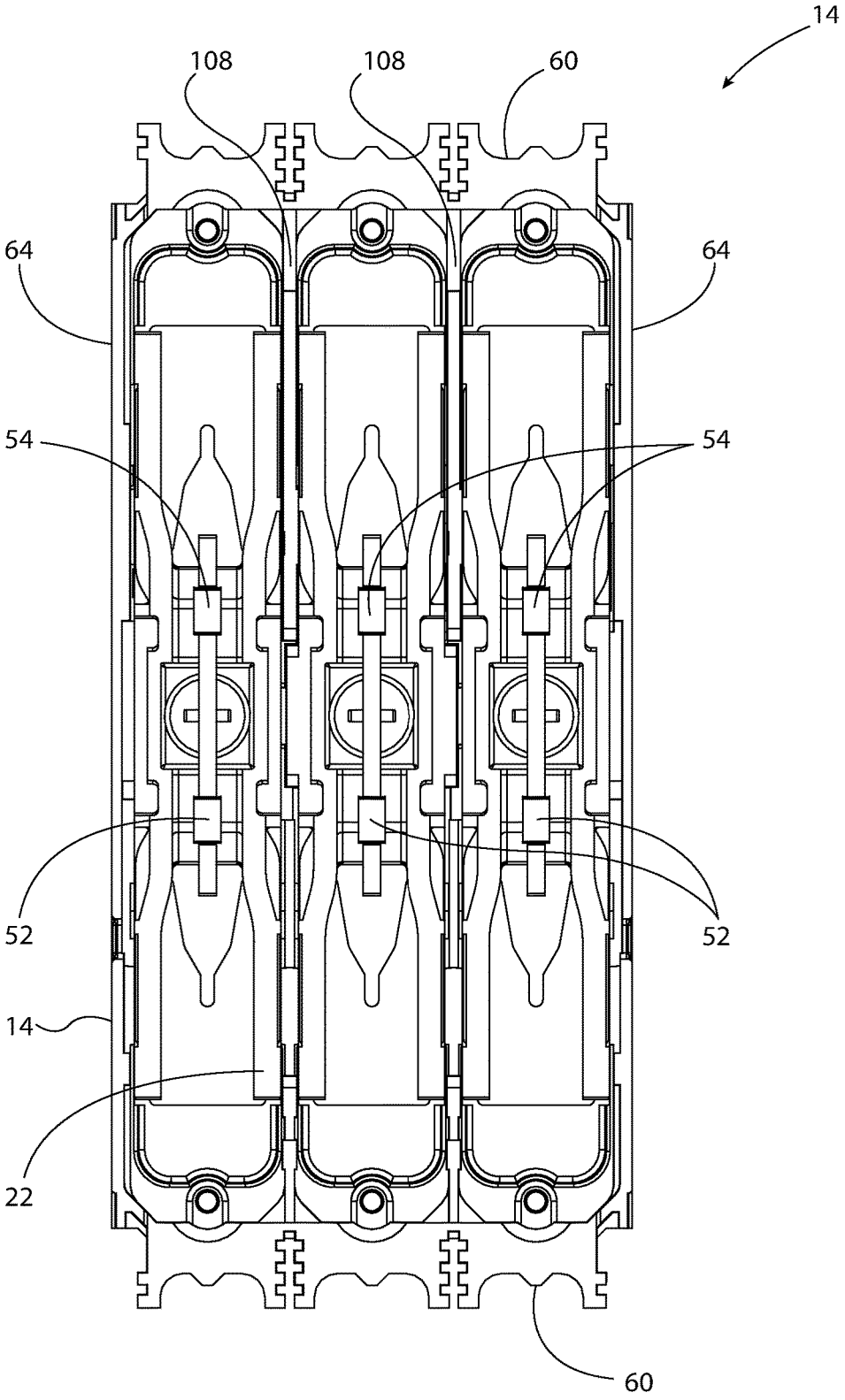
FIG. 3 is a top view of a three phase circuit breaker illustrating the arc chamber assemblies and contacts.

As shown in FIG. 2 and FIG. 3 lower housing 14 has a generally rectangular base 106 providing a slot 102 therein for receiving a standard DIN rail along the transverse axis generally within the plane of the base 106. Opposed end walls 60 extend upward from longitudinally opposite sides of the base 106 when the plane of the base 106 is horizontal. Flanking side walls 64 extend upward from the base 106 transversely opposed and perpendicular to the base 106 to span and join to opposite end walls 60 to generally define an interior housing volume between the base 106 and walls 60 and 64. Two interior walls 108 run from the opposing end walls 60 parallel to and proportionally spaced from side walls 64 to form three electrically isolated chambers into which the arc chamber assemblies 24 are positioned.

Figure 4:
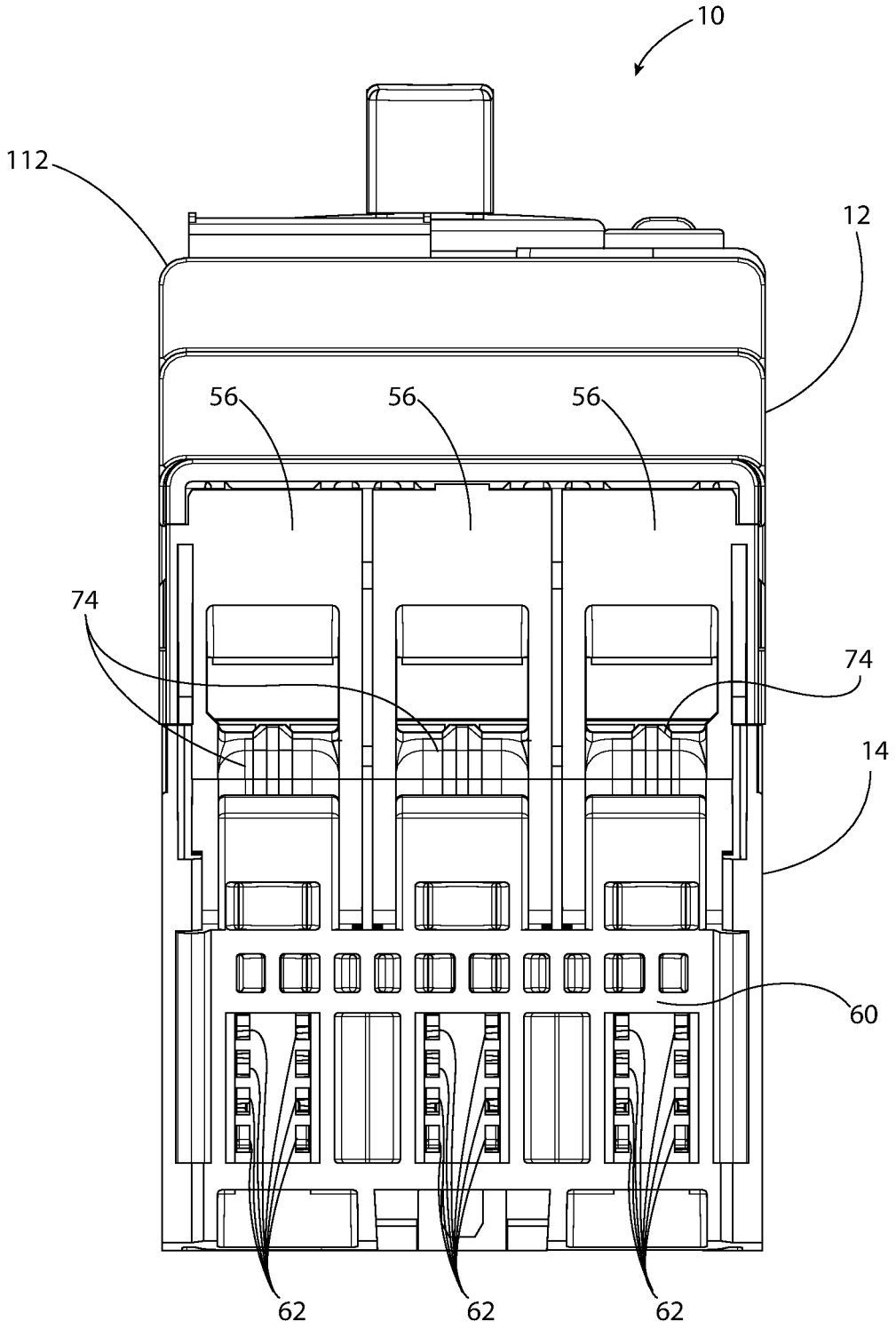
FIG. 4 is an end view of a three phase circuit breaker.

As shown in FIG. 3 with additional detail in FIG. 4, each of the two end walls 60 contain apertures 62 through which gases may be exchanged from the interior housing volume of each of the three chambers defined by side walls 64, end walls 60, base interior walls 108, and base 106. As shown in FIG. 2 and FIG. 4, above each of the apertures 62 are conductor receiving terminals 72 in the case of the input or power end of circuit breaker 10, and 74 in the case of the output or load end of circuit breaker 10, for receiving three conductors at opposite ends, line or power input 16, or load or power output 18 from longitudinal directions at electrically independent terminals 72 on machine screws or the like.

As shown in FIG. 1, a top wall 112 covers the upper housing 12 which in turn covers and substantially encloses the lower housing 14 and provides an external rotatable operating member 114 extending upward there through. Upper housing 12 hosts three sets of electrically isolated contact assemblies 100 as illustrated in FIG. 2, one for each phase. These assemblies consist of a power contact arm 68 to which a power stationary contact 48 is attached and a load contact arm 70 to which a load stationary contact 50 is attached. Each power contact arm 68 is connected to a conductor receiving terminal 72 configured to receive a conductor 16 on machine screws 98 or the like which provides electrical power to the device. Each load contact arm 70 is connected to a conductor receiving terminal 74 configured to receive a conductor 18 on machine screws 98 or the like which provides an electrical connection to the load that is controlled and protected by the device.

Figure 5:
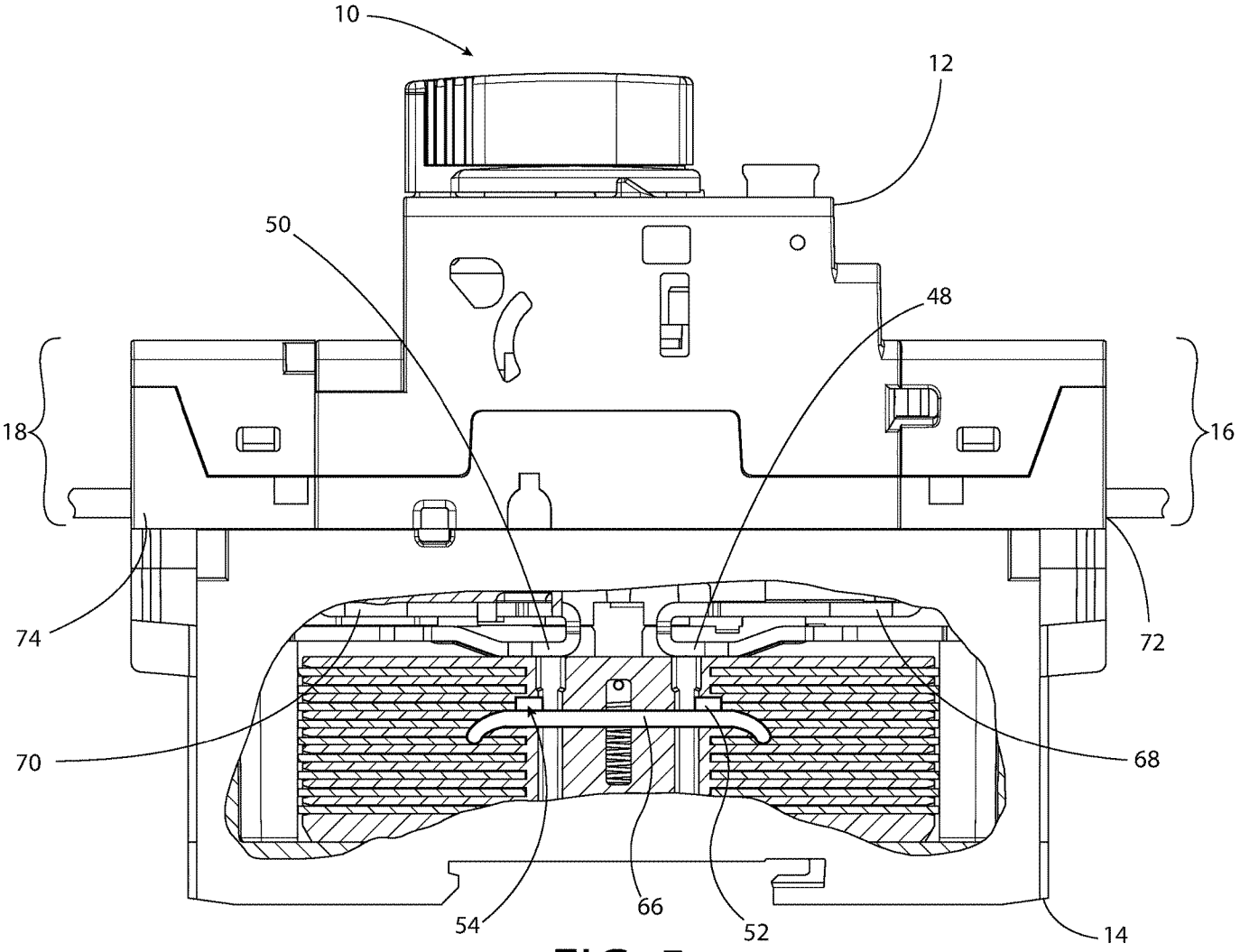
FIG. 5 is a side view with a cutaway of a three phase circuit breaker showing an arc chamber and contacts.

Referring to FIG. 2 and FIG. 3, contained within each arc chamber assembly or arc dissipating structure are a set of electrical contacts for each phase. Each set of contacts is comprised of a power moveable contact 52 and a load moveable contact 54, and a power stationary contact 48 and a load stationary contact 50. A power stationary contact 48 is attached to a power contact arm 68 that is connected to a power terminal block 72 for each phase. A load stationary contact 50 is connected to a load contact arm 70 that is connected to a load terminal block 74 for each phase. A power moveable contact 52 is connected to a load moveable contact 54 with a moveable contact arm 66 for each phase. As illustrated in FIG. 5 the power stationary contact 48 and the load stationary contact 50 for each phase are positioned towards the top of the arc chamber assembly 24 and the moveable contact arm 66 with the power moveable contact 52 and the load moveable contact 54 for each phase are positioned towards the middle portion of the arc chamber assembly 24. All of the contacts are contained within the arc chamber assembly 24 in both the energized and de-energized states.

When the circuit breaker 10 is actuated to an energized state the moveable contact arm 66 for each phase is moved into a position such that the power movable contact 52 comes into contact with the power stationary contact 48 and the load moveable contact 54 comes into contact with the load stationary contact 50 thus forming an electric circuit with electric current flowing through the moveable contact arm 66. Conversely, when the circuit breaker 10 is actuated to a de-energized state the moveable contact arm 66 moves to a position where the power movable contact 52 and the load moveable contact 54 are no longer in contact with their corresponding contacts, the power stationary contact 48 and the load stationary contact 50, causing the interruption of the electric current flow which in turn generates an electrical arc, the quenching of which is the interest of the present disclosure.

Figure 6:
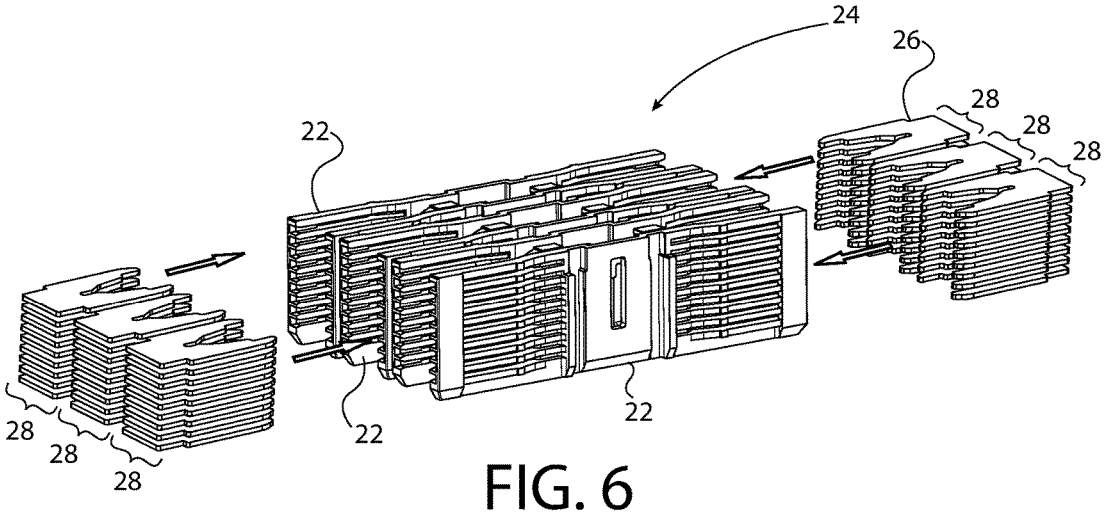
FIG. 6 is an exploded view of an arc chamber assembly including splitter plates.

As shown in FIG. 2 with additional detail in FIG. 5 each set of contacts for each phase is contained within an arc chamber assembly 24. Referring to FIG. 6, each arc chamber assembly 24 comprises an arc chamber framework 22 and two splitter plate groups 28 located at opposite ends of the arc chamber framework 22. Each splitter plate group 28 is comprised of a plurality of splitter plates 26.

One embodiment of the arc chamber framework 22 is depicted in FIG. 7*a* as a left arc chamber framework panel 30 and a right arc chamber framework panel 32. In the embodiment that is illustrated in FIG. 7*a* and FIG. 7*b* the two panels are comprised of left axial extensions 78, center walls 82, and right axial extensions 80. Other embodiments may include asymmetric body halves. Left axial extensions 78 and right axial extensions 80 contain apertures 34 which are in a spaced relation and generally parallel to one another for the purpose of engaging, spacing, and retaining a plurality of arc splitter plates 26. The left arc chamber framework panel 30 and a right arc chamber framework panel 32 join to form the center body portion 76 as shown in FIG. 7*b*. The left arc chamber framework panel 30 and the right arc chamber framework panel 32 are joined by integral, molded connecting structures. Left arc chamber framework panel female connector 38 mates with right arc chamber framework panel male connector 44 and right arc chamber framework panel female connector 42 mates with left arc chamber framework panel male connector 40 to form the arc chamber framework 22 as depicted in FIG. 7*b*. Alternate embodiments of arc chamber framework 22 may include those where connectors 38, 40, 42, and 44 are absent and the arc chamber framework panels 30 and 32 are connected only by the arc splitter plates 26. The left arc chamber framework panel 30 and a right arc chamber framework panel 32 are molded of a resin comprised of gas evolving materials such that the heat of the arc causes the material to emit a gas with arc quenching properties in addition to raising the pressure in the arc chamber assembly both of which have a positive effect on extinguishing of the arc.

An alternate embodiment of the arc chamber framework 22 is shown in FIG. 7*c*. In this embodiment the framework is molded as a single integral piece. Additional embodiments of the arc chamber framework 22 are shown in FIG. 7*d* and FIG. 7*e*. As illustrated in FIG. 7*d* the walls form a convergent to a divergent chamber shape and in FIG. 7*e* the walls form a divergent to a convergent chamber shape. The shape of the chamber is optimized so as to influence the pressure flow of the arc in order to quench the arc most efficiently. It should be understood by someone skilled in the art that the embodiments of the present disclosure as described may be further modified without departing from the spirit and scope of the present disclosure.

FIG. 8*a* is a detailed view of a splitter plate 26. The splitter plate 26 is a planar member have parallel major faces constructed of ferromagnetic material sized to fit within the periphery defined by the walls of the arc chamber 22 and of a thickness which is determined by the number of splitter plates 26 required for the splitter plate groups 28 which are comprised of a plurality of splitter plates 26 in spaced relation and generally parallel to one another in the illustrated embodiment. The number of splitter plates 26 in a splitter plate group 28 will vary depending upon the electrical parameters of the circuit interrupting device.

The splitter plate 26 includes a generally V-shaped recess 92 with a generally declining width as it progresses from the proximal to the distal end of the plate. The internal volume of the recess is defined by the internal edges 96 of the opposing splitter plate arms 90 and culminating in the splitter plate center notch 86. The general shape of the recess 92 including its contour and overall width and depth is configured so as to increase the amount of magnetic material in proximity to the power stationary contact 48, the power moveable contact 52, the load stationary contact 50, and the load moveable contact 54 such that when an electrical arc occurs at the moment that the circuit interrupting device is de-energized the attractive forces on the arc are maximized for most effective quenching.

An alternate embodiment of a splitter plate 26 with a varying recess contour is shown in FIG. 8*b*. It should be understood by someone skilled in the art that the embodiments of splitter plates in the present disclosure as described may be further modified without departing from the spirit and scope of the present disclosure.

FIG. 9 provides another perspective of an embodiment of the arc chamber assembly 24 and the splitter plate groups 28 which are comprised of a plurality of splitter plates 26 in spaced relation and generally parallel to one another. Other embodiments of arc chamber assembly 24 may be a fanned arrangement of the splitter plates 26 in the arc chamber framework 22 as illustrated in FIG. 9B. It should be understood by someone skilled in the art that the embodiments of the arrangement of the splitter plates in the present disclosure as described may be further modified without departing from the spirit and scope of the present disclosure Turning to FIG. 10*a*, the insertion of the splitter plates 26 into the arc chamber framework 22 to form the arc chamber assembly 24 is shown. As each splitter plate 26 is inserted into a splitter plate aperture 34 the axial extensions of the left arc chamber framework panel 30 and right arc chamber framework panel 32 flex slightly to allow each splitter plate to enter the splitter plate aperture 34. Upon the complete insertion of a splitter plate 26 the axial extensions of the left arc chamber framework panel 30 and right arc chamber framework panel 32 return to their original positions and a splitter plate 26 is retained by the splitter plate retainer 36 that is molded into each splitter plate aperture 34 as depicted in FIG. 10*b*. Additionally, the splitter plate arms 90 of each splitter plate 26, when completely inserted into splitter plate aperture 34 provide lateral strength to the left arc chamber framework panel 30 and the right arc chamber framework panel 32 opposing arc side pressure 94 as shown in FIG. 10*c*.

A representation of the arc event is depicted in FIG. 11*a* and FIG. 11*b*. FIG. 11*a* is a side view of the circuit breaker 10 with a cutaway showing the internals of the lower housing 14 including the relation of the power movable contact 52 to the power stationary contact 48 and the load moveable contact 54 to the load stationary contact 50. FIG. 11*b* provides a top view of lower housing 14 illustrating the flow of the gas pressure at the time of the arc event. When the circuit breaker 10 is energized the power movable contact 52 comes into contact with the power stationary contact 48 and the load moveable contact 54 comes into contact with the load stationary contact 50 thus forming an electric circuit with electric current flowing through the moveable contact arm 66. Conversely, when the circuit breaker 10 is actuated to a de-energized state the interruption of the electric current flow generates an electrical arc, the quenching of which is the interest of the present disclosure.

When the circuit breaker 10 is actuated to an energized state the moveable contact arm 66 for each phase is moved such that the power movable contact 52 comes into contact with the power stationary contact 48 and the load moveable contact 54 comes into contact with the load stationary contact 50 thus forming an electric circuit with electric current flowing through the moveable contact arm 66. Conversely, when the circuit breaker 10 is actuated to a de-energized state the interruption of the electric current flow generates an electrical arc. The generation of an electric arc results in a rapid increase in temperature and pressure internal to each arc chamber assembly 24. Experimentation has shown that containing the pressure inside each arc chamber assembly 24 will significantly decrease the time required to quench the arc. The nature of the arc chamber assembly 24 is such that the gas produced as a result of the electrical arc 46 is restricted to the interior of the arc chamber assembly 24 and cools as it flows through the splitter plate groups 28 and is substantially only allowed to exit the circuit breaker 10 through the lower housing apertures 62 as illustrated in FIG. 4. As previously discussed, the shape of the walls of the arc chamber framework 22 can improve the rapid quenching of the electrical arc. The shape of the sides may be such that the arc chamber framework 22 has a generally convergent profile from the center body portion 76 to the distal end of the arc chamber framework 22, a generally divergent profile over the same length, a divergent and then convergent profile, or a convergent to divergent profile over the length of the arc chamber framework 22 as illustrated in FIG. 7*c*, FIG. 7*d*, and FIG. 7*e*.

Each splitter plate 26 as part of the splitter plate groups 28 attracts the electromagnetic portion of the arc and splits the arc in order to quickly raise the arc voltage which results in the arc being extinguished more quickly. Placing the splitter plate groups 28 in close proximity to the location of the initiation of the arc, that being the power movable contact 52 and the power stationary contact 48 and the load moveable contact 54 and the load stationary contact 50 results in improved arc quenching. The shape of the splitter plates 26, specifically the V-shaped recess 92 may be optimized in order to improve the arc quenching ability of the arc chamber assembly 24. An alternate embodiment of the splitter plate 26 is shown in FIG. 8*b*.

Referring to FIG. 12, a flowchart representing the method of manufacturing and assembly of an arc chamber assembly is presented. The first step, 116 is the manufacture of the arc chamber panels. As illustrated in FIG. 7*a* a left arc chamber framework panel 30 and a right arc chamber framework panel 32 are manufactured from an ablating source material. In a preferred embodiment left arc chamber framework panel 30 and right arc chamber framework panel 32 are assembled 118 by inserting right arc chamber framework panel male connector 44 into left arc chamber framework panel female connector 38 and inserting left arc chamber framework panel male connector 40 into right arc chamber framework panel female connector 42 to form an arc chamber framework 22 of FIG. 6. As depicted in FIG. 10*a* splitter plates 26 are inserted 120 into arc chamber assembly 22 to form arc chamber assembly 24. Finally, each arc chamber assembly 24 is inserted 122 into the lower housing 14 as illustrated in FIG. 2.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An electric circuit interrupting device comprising:

an upper housing configured to be secured to a lower housing in order to substantially enclose a housing;

input and output terminals configured to receive electrical current from a source and convey it to a load;

at least one primary current carrying path including at least one stationary contact and one moveable contact contained within an arc quenching apparatus forming an electrical circuit in conjunction with the input and output terminals, the moveable contact being separable from the stationary contact by a linking member;

the lower housing defining a plurality of parallel, electrically isolated phase sections formed by integral cavity partitions so as to separate one phase section from another, each phase section configured to receive an arc quenching apparatus;

the arc quenching apparatus comprising;

a plurality of arc splitter plates;

a contiguous unitary body having a first side wall, a second side wall parallel to and spaced apart from the first side wall, and a base wall perpendicular to the first and second side walls interconnecting the first and second side walls at distal ends defining a partially enclosed volume with a central cavity adapted to receive the moveable contact;

a plurality of parallel axial grooves formed in spaced relation in each of the first and second side walls extending from proximate the central cavity to the distal end where a retention notch is adapted to retain each of the plurality of arc splitter plates, the axial grooves adapted to receive each of the plurality of arc splitter plates; defining therebetween a plurality of passages allowing unencumbered venting of gases resulting from an electrical arc to pass solely through the distal end of the arc quenching apparatus.

2. The electric circuit interrupting device of claim 1, wherein each of an end wall of the housing contain a plurality of apertures for exchange of gases.

3. The electric circuit interrupting device of claim 1, wherein gas streams are substantially prevented from exiting the device from other than a plurality of apertures on each of an end wall of the housing.

4. The electric circuit interrupting device of claim 1, wherein each phase section is configured to receive the linking member that transmits motion from operator to the moveable contact where the operator may comprise an external component and the linking member.

5. An arc quenching apparatus comprising:

a plurality of arc splitting plates;

a contiguous unitary body having a first side wall, a second side wall parallel to and spaced apart from the first side wall, and a base wall perpendicular to the first and second side wall at distal ends interconnecting the first and second side walls defining a partially enclosed volume with a central cavity adapted to receive moveable contact, open only at top and opposing distal ends;

a plurality of parallel axial grooves formed in spaced relation in each of the first and second side walls extending from proximate the central cavity to the distal end where a retention notch is adapted to retain each of the plurality of arc splitter plates, the axial grooves adapted to receive each of the plurality of arc splitter plates; defining therebetween a plurality of relatively thin but wide passages allowing unencumbered venting of gases resulting from an electrical arc to pass solely through the distal end of the arc quenching apparatus.

6. The apparatus of claim 5, wherein the first and second side walls are shaped to direct gas streams from arcs through the splitter plates to open distal ends such that in operation gas streams are substantially prevented from exiting the apparatus from other than the open distal ends.

7. The apparatus of claim 5, wherein the first side wall, second side wall, and base are molded of a resin with ablative properties.

8. The apparatus of claim 5, wherein the first side wall, and second side wall are shaped such that they increase surface area in which an arc is in contact with ablating source material in order to maximize arc suppression.

* * * * *